United States Patent [19]

Booker, Jr.

[11] 4,155,426

[45] May 22, 1979

[54] DIGITAL SPEED PATTERN GENERATOR

[75] Inventor: Clyde A. Booker, Jr., Churchill, Pa.

[73] Assignee: Westinghouse Electric Corp., Pittsburgh, Pa.

[21] Appl. No.: 903,375

[22] Filed: May 5, 1978

[51] Int. Cl.[2] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,589,474 | 6/1971 | Wavre | 187/29 |
| 3,743,055 | 7/1973 | Hoelscher et al. | 187/29 |
| 3,747,710 | 7/1973 | Winkler | 187/29 |
| 3,774,729 | 11/1973 | Winkler | 187/29 |
| 3,777,855 | 12/1973 | Boyldew et al. | 187/29 |
| 3,783,974 | 1/1974 | Gilbert et al. | 187/29 |
| 4,046,229 | 9/1977 | Kernick et al. | 187/29 |
| 4,102,436 | 7/1978 | Kernick et al. | 187/29 |

*Primary Examiner*—Gene Z. Rubinson
*Assistant Examiner*—W. E. Duncanson, Jr.
*Attorney, Agent, or Firm*—D. R. Lackey

[57] ABSTRACT

A digital speed pattern generator which may have acceleration, constant velocity, and deceleration phases, which is particularly advantageous for short runs in which the constant velocity phase is not reached, as well as for longer runs, such as required for high speed elevators. A first digital speed pattern signal is generated from a pulse train which has a constant average frequency related to maximum jerk. A second digital speed pattern signal is generated during the slow-down or deceleration phase from distance pulses responsive to movement of the elevator car. The first digital speed pattern signal is suitable for use as the effective speed pattern for motor control throughout the acceleration, constant velocity and deceleration phases of the speed pattern signal. The first digital speed pattern signal is slaved to follow the second digital speed pattern signal during a deceleration phase of the speed pattern, within the constraints applicable to the generation of the first digital speed pattern signal.

23 Claims, 8 Drawing Figures

FROM FIG. 7
270
NL16 ?
272
J+Jk→J
274
CARRY ?
276
SQRT set ?
278
aof set ?
280
a=amax ?
282
a+1→a
286
SQRT ?
288
aof set ?
292
OUTPUT V
294
V−Vk→V
296
V≪Vmin ?
298
LOAD Vmin
300
NL16 ?
302
SQF ?
304
SET SQF-
START SQRT-
WHEN FINISHED
RESET SQF
LOAD Vc
306
set SQRT
308
V−Vc
310
POS. ?
312
a=aUL ?
314
a+1→a
316
a=aLL ?
318
a−1→a
320
J+Jk→J
322
CARRY ?
324
a=0 ?
326
a−1→a
328
a=0 ?
330
a−1→a
332
A+a→A
334
CARRY ?
336
V+Vk→V
338
V≫Vmax ?
340
LOAD Vmax
342
set aof
284
A+a→A
290
CARRY ?
230
EXIT

DIGITAL SPEED PATTERN GENERATOR

BACKGROUND OF THE INVENTION

1. Field of the Invention

The invention relates in general to speed pattern generators for motor speed control, and more specifically to speed pattern generators in which a velocity signal is developed in digital form before any analog conversion thereof.

2. Description of the Prior Art

Certain applications of controllable speed motors include a comparison of the desired and actual speeds. The difference or error is used to correct the motor speed to follow the desired or patterned speed. When the motor is used to transport persons, such as an elevator or a train, it is important that the rate of change of acceleration, i.e., jerk, be kept within the limits of comfort, such as a maximum of about 8 ft./sec.$^3$, that the acceleration be limited to a predetermined maximum, such as about 4 ft./sec.$^2$, and that the velocity be limited to the rated or contract speed with little or no overshoot. The attainment of rated speed without overshoot is important, as it enables overspeed detectors and safeties to be set closer to the rated speed without experiencing nuisance trips.

A speed pattern generator for a high speed elevator system, such as an elevator system having a rated speed between 500 fpm. and 1800 fpm., must also be able to handle "short runs", i.e., a run in which the elevator car does not attain rated speed, without exceeding the maximum jerk as the speed pattern changes from maximum positive acceleration to maximum negative acceleration, hereinafter referred to as deceleration. In addition to generating a speed pattern with the safety and comfort of the passengers in mind, it is also important that the speed pattern signal direct the elevator car without undue delay or sluggishness at any part of the speed pattern, in order to provide the most efficient service within the specified jerk, acceleration and velocity constraints.

The more accurate the speed pattern signal, the more efficient the elevator service, as allowances for error degrade response time. Thus, analog computation steps in the development of the speed pattern generator are to be minimized, as analog elements, such as operational amplifiers, are subject to temperature errors and drift.

Certain speed pattern generators of the prior art have taken advantage of digital precision, such as by utilizing registers and adders to perform certain digital calculations. The economic attractiveness and versatility of the microprocessor, which, with its burned-in PROMS forms a dedicated digital computer for performing the necessary logical and computational functions, makes it even more attractive to develop new and improved digital speed pattern generator concepts.

U.S. Pat. No. 3,589,474, entitled "Digital Pattern Generator For Motor Speed Control", which is assigned to the same assignee as the present application, discloses a speed pattern generator in which a digital count is developed from distance pulses generated by car movement. Bias pulses are initially added to the counter to start the car, and the counter counts the incoming distance pulses during acceleration. A nonlinear D/A converter develops the speed pattern signals from the count. The count always represents the distance required to stop the car with a deceleration rate equal to the acceleration rate. Upon reaching rated speed, the counter ceases to count the distance pulses, and the speed pattern developed from the constant count is a constant value. When slow-down is initiated, the counter is decremented by the distance pulses, and the speed pattern is derived from this reducing count.

U.S. Pat. No. 3,747,710, entitled "Distance Slow-Down Control For Elevator Systems", which is assigned to the same assignee as the present application, discloses generating the slow-down pattern from a digital count responsive to the slow-down distance between the elevator car and the stopping point, as in the hereinbefore mentioned U.S. Pat. No. 3,589,474, with additional means for automatically calibrating the control during each run to enable a smooth transition from the calculated distance-to-go speed pattern to a hatch transducer speed pattern at a point 10 inches from the target floor.

U.S. Pat. No. 4,046,229, entitled "Elevator System", and co-pending application Ser. No. 640,300, filed Dec. 12, 1975, entitled "Elevator System", now U.S. Pat. No. 4,102,436, collectively disclose and claim different aspects of an elevator system in which a first pulse train is generated responsive to actual car movement, and a second pulse train is generated responsive to the desired movement. A counter keeps an accounting of the difference in the counts, and the difference count controls the speed of the elevator car.

SUMMARY OF THE INVENTION

Briefly, the present invention is a new and improved digital speed pattern generator which generates a first digital speed pattern signal from a first pulse train having a constant average pulse rate. The pulse rate is selected to indicate the rate at which a predetermined acceleration increment should be added to, or subtracted from, acceleration counting means.

Digital integration means provides a second pulse train responsive to the count on the acceleration counting means. The second pulse train indicates the rate at which a predetermined velocity increment should be added to, or subtracted from, velocity counting means. A D/A converter provides an analog speed pattern signal in response to the count on the velocity counting means.

A second digital speed pattern signal is provided during the slow-down phase of the first digital speed pattern generator signal, with the second digital speed pattern signal being responsive to the distance of the controlled device, such as an elevator car, from the desired stopping point. Instead of substituting the second digital speed pattern for the first digital speed pattern, the first digital speed pattern is slaved to follow the second digital speed pattern signal, within predetermined limits. Thus, no switching or blending between the two speed pattern signals at a predetermined transition point is required, and the analog speed pattern signal always has the benefit of the inherent jerk, acceleration and velocity constraints applied to the generation of the first digital speed pattern signal.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
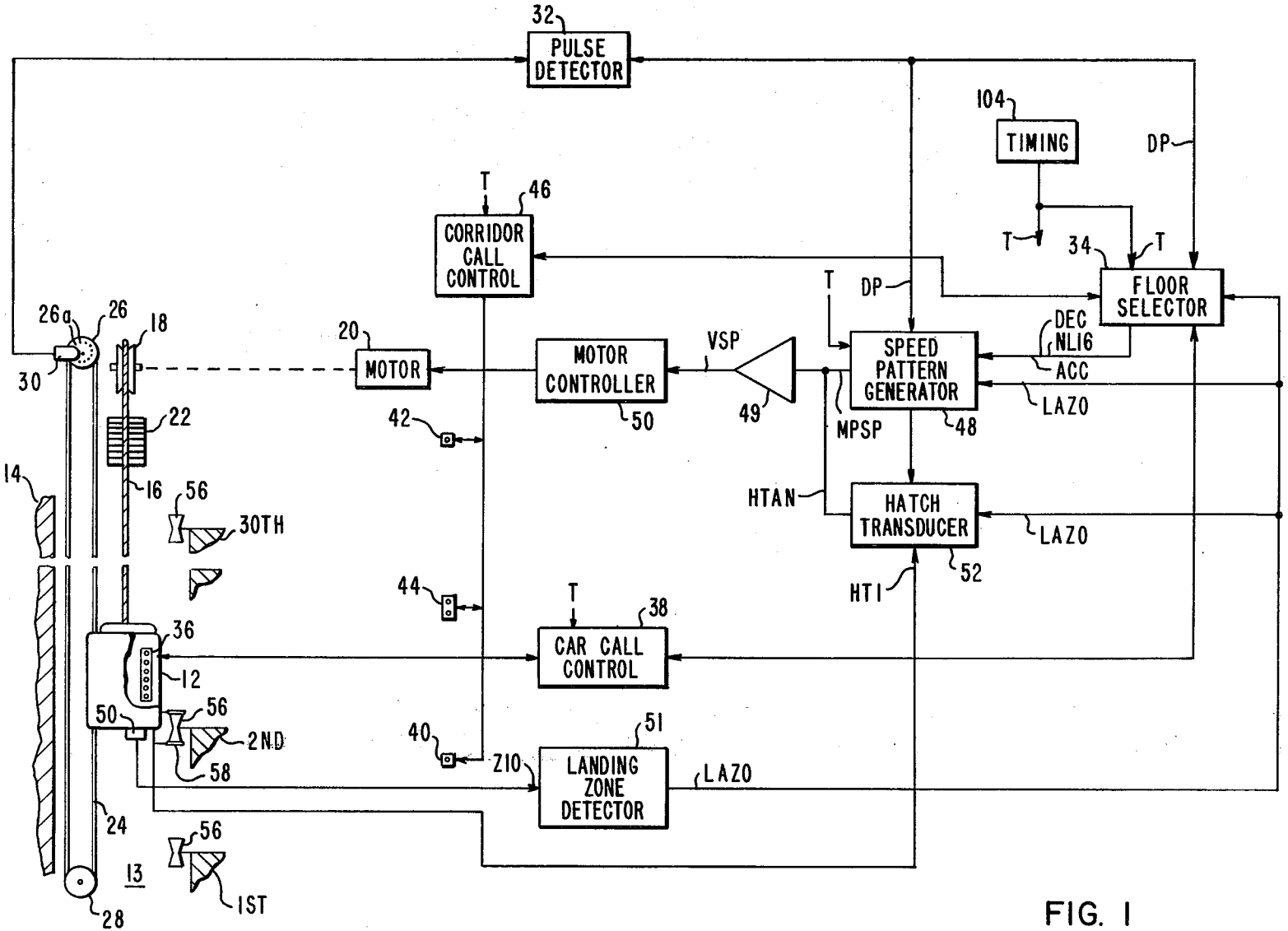
FIG. 1 is a partially schematic and partially block diagram of an elevator system which may include a speed pattern generator constructed according to the teachings of the invention.

Referring now to the drawings, and to FIG. 1 in particular, there is shown an elevator system 10 wherein an elevator car is mounted in a hatchway 13 for movement relative to a structure 14 having a plurality of landings. For purposes of example, it will be assumed that the building has 30 landings, with only the first, second and thirtieth landings being shown in order to simplify the drawing. The elevator car 12 is supported by ropes 16 which are reeved over a traction sheave 18 mounted on the shaft of a drive motor 20. The drive motor 20 is preferably a direct current motor, such as used in the Ward-Leonard Drive System, with the Ward-Leonard system utilizing either a motor-generator set, or solid-state components. A counterweight 22 is connected to the other ends of the ropes 16. A governor rope 24, which is connected to the elevator car 12, is reeved over a governor sheave 26 located above the highest point of travel of the car in the hatchway 13, and over a pulley 28 located at the bottom of the hatchway. A pickup 30 is disposed to detect movement of the elevator car 12 through the effect of circumferentially spaced openings **26*a* in the governor sheave 26. The openings in the governor sheave are spaced to provide a pulse for each standard increment of travel of the elevator car, such as a pulse for each 0.5 inch of car travel. Pickup 30, which may be of any suitable type, such as optical or magnetic, provides pulses in response to the movement of the openings 26*a* in the governor sheave. Pickup 30 is connected to a pulse detector 32 which provides distance pulses DP for a floor selector 34, and for a speed pattern generator 48**. Distance pulses DP may be developed in any other suitable manner, such as by a pickup disposed on the elevator car which operates with regularly spaced indicia in the hatchway.

Car calls, as registered by pushbutton array 36 mounted in the car 12, are recorded and serialized in car call control 38, and the resulting serialized car call information is directed to the floor selector 34.

Corridor calls, as registered by push buttons mounted in the corridors, such as the up push botton 40 located at the first floor, the down push button 42 located at the thirtieth floor, and the up and down push buttons 44 located at the second and other intermediate floors, are recorded and serialized in corridor call control 46. The resulting serialized corridor call information is directed to the floor selector 34.

The floor selector 34 processes the distance pulses DP from the pulse detector 32 to develop information concerning the position of the car 12 in the hatchway 13. The floor selector 34 keeps track of the elevator car 12, the calls for elevator service, it provides the "request to accelerate" signal ACC to the speed pattern generator 48, and it provides the "request to declerate" signal DEC for the speed pattern generator 48 at the precise time required for the elevator car to decelerate according to a predetermined floor for which a call for service has been registered. The floor selector additionally provides a signal NL 16 when the elevator car is 16 inches from the target floor. The floor selector 34 additionally provides signals for controlling such auxiliary devices as the door operator for the elevator car, the hall lanterns, and it also controls the resetting of the car call and corridor call controls when a car or corridor call has been serviced.

The speed pattern generator 48 generates a speed reference signal MPSP for an amplifier 49, which provides a speed pattern signal VSP for a controller 50. Controller 50 provides the drive voltage for motor 20.

The speed pattern generator 48 provides the speed pattern signal for controlling the drive motor 20 from the start of the run until the elevator car reaches a point 10 inches from the target floor. A precise car position speed pattern is then substituted for the speed pattern signal provided by the speed pattern generator 48, which brings the elevator car to floor level and maintains the car at floor level as the load in the elevator car changes.

A landing zone detector system provides car positional signals adjacent to a floor at which the elevator car is to stop. The landing zone detector system includes a pickup 50, which provides a signal Z10 when the elevator car reaches the 10 inch point, such as in response to a target located adjacent to each floor, and it additionally includes processing control 51 which processes the signal Z10 to provide a signal LAZO for controlling the switching point between the two speed pattern signals. U.S. Pat. No. 4,019,606, which is assigned to the same assignee as the present application, discloses a suitable landing zone detector system which may be used.

A hatch transducer system provides signals for generating the speed pattern signal for landing and leveling the elevator car. The hatch transducer system includes inductor plates 56 disposed at each landing, and a transformer 58 located on the elevator car 12. The transformer 58 provides a signal HTl for processing control 52, which in turn provides the speed pattern signal HTAN. When signal LAZO goes true at the 10 inch point, signal HTAN is substituted for signal MPSP. U.S. Pat. No. 3,207,265, which is assigned to the same assignee as the present application, discloses a hatch transducer system which may be used.

The motor controller 50 includes a speed regulator responsive to the reference pattern provided by the speed pattern generator 48. The speed control is derived from a comparison of the actual speed of the motor and that called for by the reference pattern, such as by using a drag magnet regulator, such as disclosed in U.S. Pat. Nos. 2,874,806 and 3,207,265, or by using a servo control loop, such as disclosed in U.S. Pat. Nos. 4,030,570; 3,749,204; 3,713,012 and 3,713,011, all of which are assigned to the same assignee as the present application.

The present invention relates to a new and improved speed pattern generator which may be used for the speed pattern generator function 48. The new and improved speed pattern generator 48 may be constructed of hard-wired registers and logic circuits, or the new processing and logic functions may be performed by a microprocessor. If a microprocessor is used, the floor selector function 34 may also be performed by a suitable program in the same microprocessor, in which event the various signals developed by the floor selector for the speed pattern generator would be available at predetermined memory locations in the microprocessor. Since the floor selector function forms no part of the present invention, it will be assumed, for purposes of example, that the floor selector signals ACC, DEC and NL16 are produced in an external floor selector, such as the floor selector disclosed in U.S. Pat. No. 3,750,850, entitled "Floor Selector For An Elevator", which is assigned to the same assignee as the present application.

Figure 2:
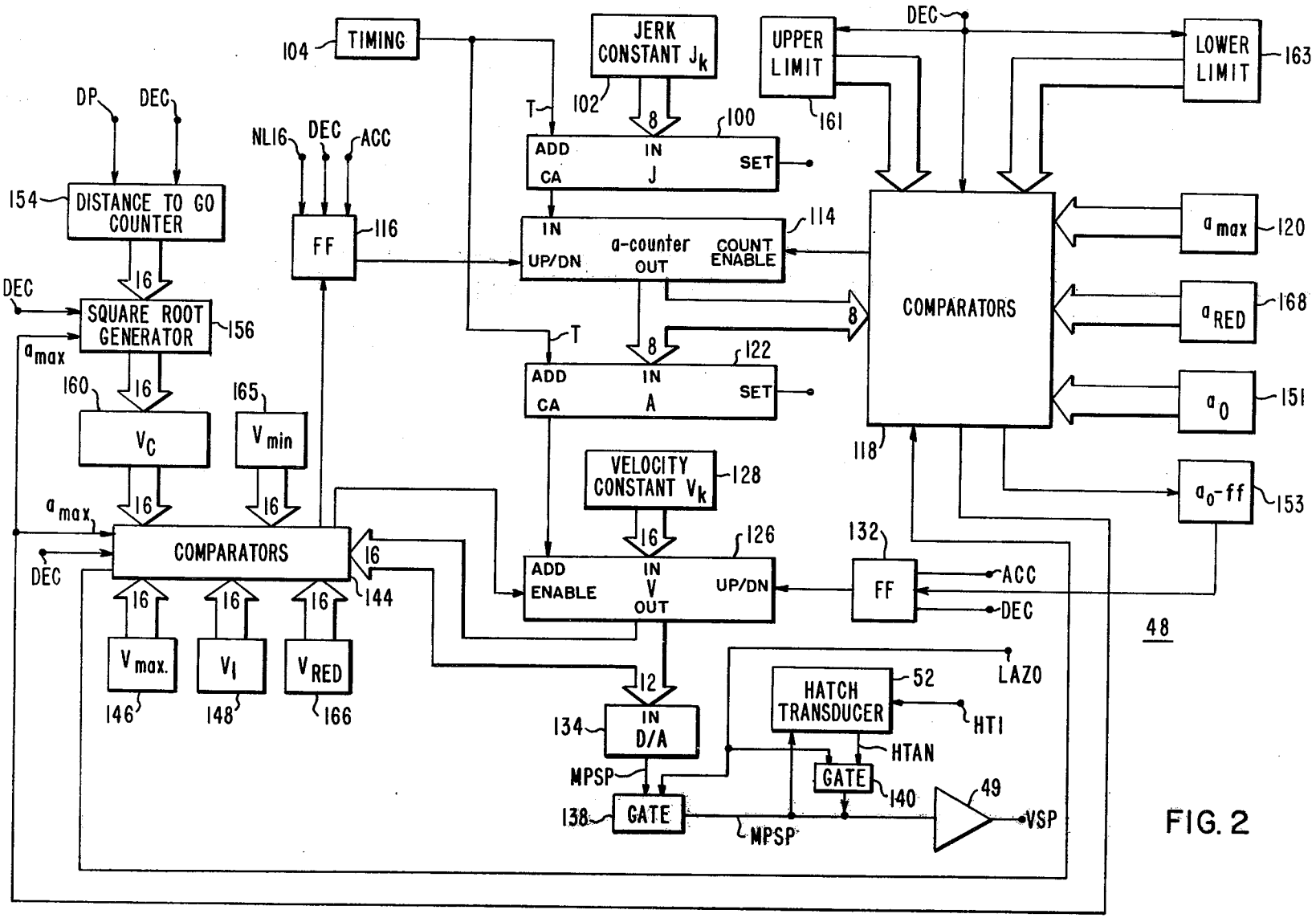
FIG. 2 is a detailed block diagram which functionally illustrates a digital speed pattern generator constructed according to the teachings of the invention.
Figure 3:
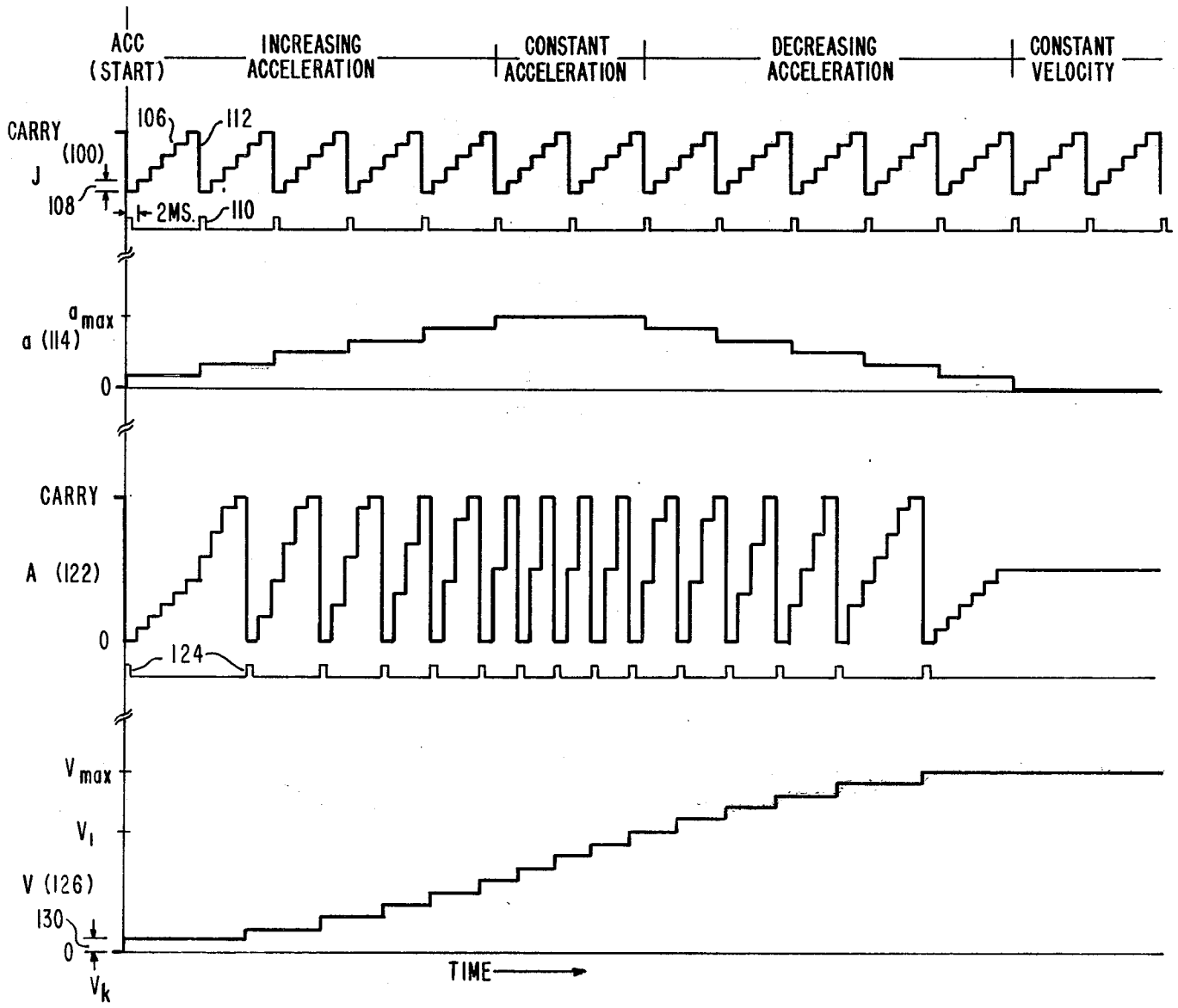
FIGS. 3 and 4 are graphs which set forth wave forms useful in understanding the teachings of the invention illustrated in FIG. 2.
Figure 4:
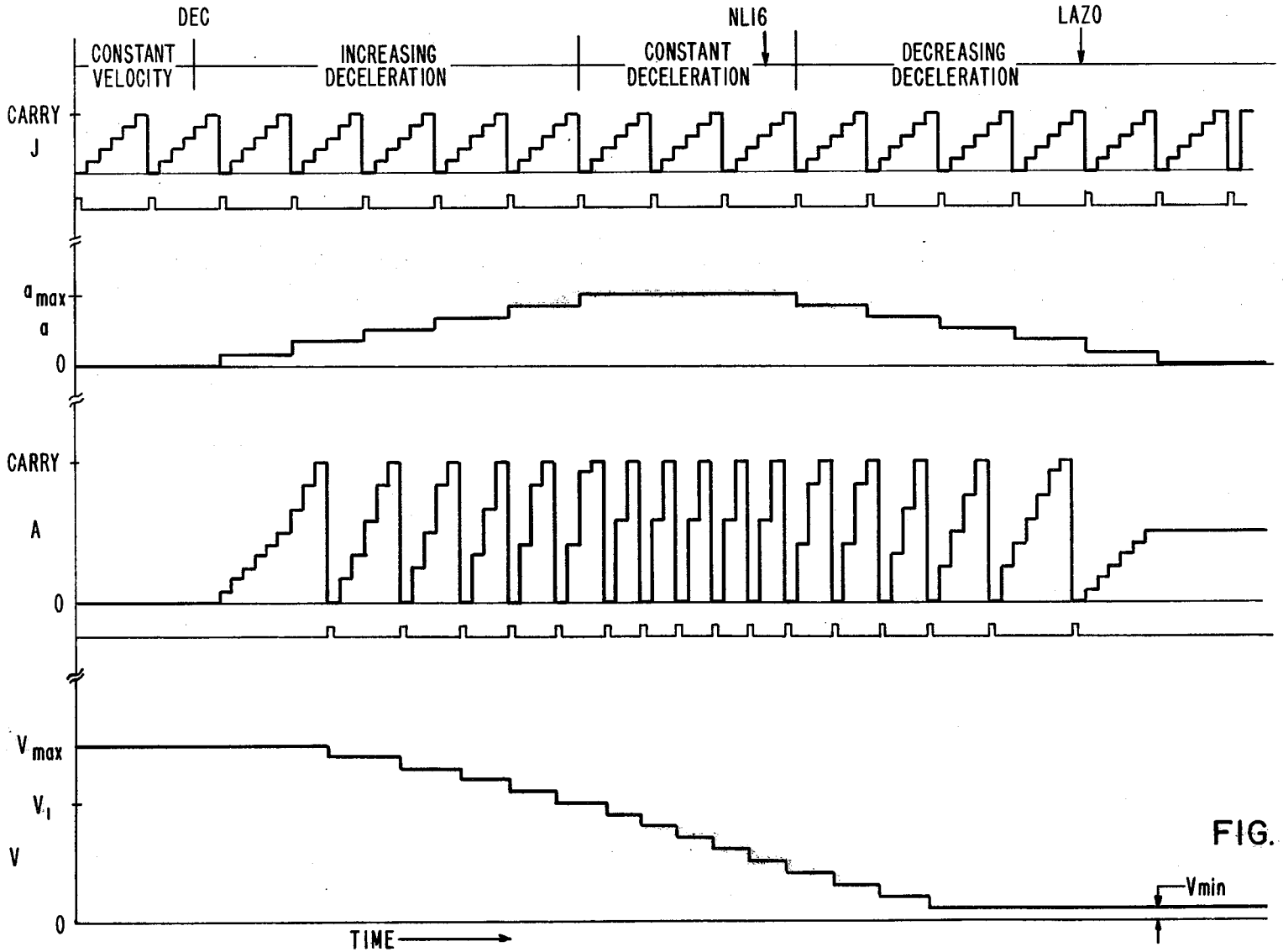

FIG. 2 is a detailed block diagram of a speed pattern generator 48 constructed according to the teachings of the invention, which may be used for the speed pattern generator 48 shown functionally in FIG. 1. FIGS. 3 and 4 are graphs which illustrate binary counts and pulse trains developed by the functions shown in FIG. 2, and these graphs will be referred to when describing the functions of FIG. 2.

In a digital speed pattern generator the pattern will be changed incrementally, and some rate must be chosen as the maximum rate at which a predetermined increment may be added to, or subtracted from, the speed pattern. Since one of the objects of the invention is to provide a new and improved digital speed pattern generator which may be implemented with microprocessor, the rate should be selected with this implementation in mind. For purposes of example, Intel's Microprocessor 8080A will be assumed, with an 18 MHz crystal supplying the clock after being counted down to 2 MHz. This signal is further counted down to 500 Hz to generate interrupts every two milliseconds, which are used for pattern generation. Thus, an iteration rate of 500 Hz will be assumed.

It will also be assumed that the digital velocity of speed pattern signal will be generated as a 16-bit value in a 16 bit velocity register V. If the motor controller 50 requires an analog signal, the 16 bit signal may be truncated to 12 bits before being applied to a digital to analog converter. The D/A converter would form the final output of the digital speed pattern generator. A 16 bit binary number has a full scale value of 65,535. If the 16-bit velocity register V is updated one count at a time, the 50 Hz iteration rate selected would be much too low, as it would take 1 second to advance the count to 500, and 131 seconds to advance the count to 65,535. Thus, to maintain the 500 Hz iteration rate selected, a value greater than 1 must be added to the velocity register V, each time the velocity register is updated.

Assuming the full scale velocity of the velocity register V to be 500 fpm., i.e., 500 fpm. equals 65,535, and the maximum acceleration to be 5 ft./sec.$^2$, the minimum value or increment to be added to the velocity register at the 500 Hz rate would be:

$$\text{Velocity Increment} = \frac{\text{Full Scale Count} \times \text{Acceleration (ft./sec.}^2)}{\text{Velocity (ft./sec.)} \times \text{iteration rate}} = \frac{65{,}535 \times 5}{(500 \div 60) \times 500} = 78.6$$

The count on the velocity register V is built up, according to the teachings of the invention, in response to the binary count on an acceleration register a. For purposes of example, it will be assumed that an 8-bit register will be used which has a maximum count of 255. For convenience, it will be assumed that the count in the acceleration register will be changed by an increment of one. To allow the nominal rated acceleration to be exceeded, if necessary during a portion of the speed pattern, it is not desirable to make nominal rated acceleration equal to a count of 255. Assuming that the full scale count is to be achievable within the maximum desired jerk constraint at the iteration rate of 500 Hz, a value for nominal rated acceleration of 186 is selected. Thus, the velocity need only be incremented at a frequency of $500 \times 186 \div 256$, or 363 Hz to achieve the nominal rated acceleration. The choice of 186 is somewhat arbitrary, but it is a convenient choice as it results in reasonable values for all velocity and acceleration ratings.

Now, assuming a typical elevator system which has a rated velocity of 500 fpm., a rated acceleration of 4 ft./sec.$^2$, and rated jerk of 8 ft./sec$^3$, the velocity increment would be, using the iteration rate of 363:

$$\text{velocity increment} = \frac{65{,}535 \times 4}{(500 \div 60) \times 363} = 86.6\ (87)$$

Jerk and acceleration are related by the following:

$$J = a/t$$

Thus, with an acceleration of 4 ft./sec.$^2$ and a jerk of 8 ft./sec.$^3$, the acceleration count of 186, previously selected, must be reached in linear increments in:

$$t = a/J = 4/8 = 0.5 \text{ second}$$

This is a rate of 186/0.5 or 372 Hz. Thus, if the acceleration register is updated by a value of one at the rate of 372 Hz, the acceleration cannot exceed the maximum jerk limitation of 8 ft./sec.$^3$.

The invention includes means for generating a first pulse train at an average rate which indicates the maximum rate (372 Hz in this example) at which the acceleration count can be changed by the acceleration increment selected, which increment is one in this example. The generation of the digital speed pattern is based on this first pulse rate, and regardless of how this digital speed pattern is slaved to follow another digital speed pattern, as will be hereinafter described, it cannot change at a rate which exceeds this built-in jerk limitation.

While the first pulse train may be generated in any well-known manner, a pulse generator which is convenient for either a microprocessor or for hard-wired registered and logic components, is simply to provide a register to which a predetermined increment is added at a regular rate, with the "carry" generated when the register overflows being used to generate the pulse train. Thus, the frequency is selected by selecting the increment which is added to the register, and the frequency, and thus the jerk limitation may be changed, if desired, by selecting another increment.

For example, assuming an 8-bit jerk register J, and using 372 Hz. as the desired output frequency of the register, and the 500 Hz interrupt frequency as the incrementing rate, the increment to be added to the jerk register would be given by:

$$\text{Desired output frequency} = \frac{N \times \text{incrementing rate}}{\text{capacity of register}},$$

where N is equal to the increment. Thus, N is equal to 372×256/500, or 190.46 (190).

Thus, as illustrated in FIG. 2, an 8-bit jerk or J register 100 is loaded by means 102 which provides the jerk constant $J_K$, i.e., an 8-bit binary count equal to 190 (10111110), each time its "add" input is pulsed by timing function 104. Timing function 104 provides the 500 Hz timing signal. The jerk register 100 may be pre-set to all ones at the start of the run, such as by a circuit which provides a pulse when the request to accelerate signal ACC goes true, so that a pulse will be provided at its carry output CA on the very first increment added to the jerk register 100. While the pulse rate will not be exactly regular when adding 190 to a 256 capacity register every 2 milliseconds, it will provide an average pulse rate of 372 Hz, which is all that is required to provide the desired jerk limitation.

Because it is not practical to graphically illustrate the generation of the first pulse train using the actual values of the example, FIGS. 3 and 4 "compress" the graph by assuming substantially fewer steps in the development of the speed pattern, and the J register 100 is illustrated as being incremented many more times in order to achieve a carry over, in order to illustrate a uniform first pulse train in a small space. Curve portion 106 illustrates the incrementing of register 100 by an increment referenced 108 every 2 milliseconds, producing a carry pulse 110 upon overflow of the jerk register 100 at 112.

Upon receiving a true signal ACC at the start of a run, speed pattern generator 48 enables an 8-bit acceleration or "a" counter 114 to count in the up direction, such as by a memory or flip-flop 116 which is set by signal ACC to a condition which enables counter 114 to count up. The counter 114 is enabled to count by an input signal at its "count enable" input from a comparator function 118. Comparator function 118 provides a signal which enables counter 114, at the start of a run, and the enable continues until some pre-set acceleration limit has been reached.

The count on the acceleration counter 114 starts to build up at the frequency of the first pulse train. When the count on the counter 114 reaches the binary equivalent of 186 (10111010), as determined by comparator 118 and the $a_{max}$ limit 120, the comparator 118 disables the "count enable" input of counter 114 and this count is held during the constant acceleration phase of the run.

This jerk limited transition from zero acceleration to maximum acceleration on counter 114 is the basis for the initial phase of the speed pattern. The speed pattern is developed from the count on the acceleration counter 114. Digital integration means is provided which includes an 8-bit "A" register 122 which adds the count of the acceleration counter 114 to its count, in response to the 500 Hz timing signal from the timing function 104. When register 122 overflows, its carry output provides a pulse 124 shown in FIG. 3, and these pulses provide the second pulse train. As illustrated in the graph of FIG. 3, register 122 will reach overflow faster and faster as the count on the acceleration counter 114 builds up, and the pulses 124 will be produced at an increasing rate until the acceleration counter 114 reaches $a_{max}$, at which point the pulses 124 will be provided at a constant rate.

The pulses 124 of the second pulse train are produced at the rate at which the velocity increment (87 in the example) should be added to a velocity or "V" register 126. The selected velocity constant $V_k$ or increment (87) is set in the register 128 in the form of a 16-bit binary number 0000 0000 0101 0111. Register 126 is set to count in the up direction when signal ACC goes true, such as by a memory or flip-flop 132. The A register 122 may be set to all 1's when signal ACC goes true, to provide a carry output on the first timing pulse after ACC goes true. Thus, register 126 will be incremented by the velocity constant $V_k$, referenced 130 in FIG. 3, on each pulse 124 of the second pulse train. The increasing rate of pulses 124 builds the digital velocity signal on register 126 within the jerk constraint determined by the rate of the first pulse train.

The 16-bit output of the velocity register 126 defines the speed pattern in digital form. This output may be truncated to 12 bits and applied to a digital to analog converter 134. The D/A converter 134 provides an analog speed pattern signal MPSP which is applied to amplifier 49 via a gate 138. Gate 138 is enabled until signal LAZO from the landing zone detector 51 goes true, indicating the elevator car is 10 inches from the target floor. Amplifier 49 provides the speed pattern signal VSP which is applied to the motor controller 50, as shown in FIG. 1.

Figure 5:
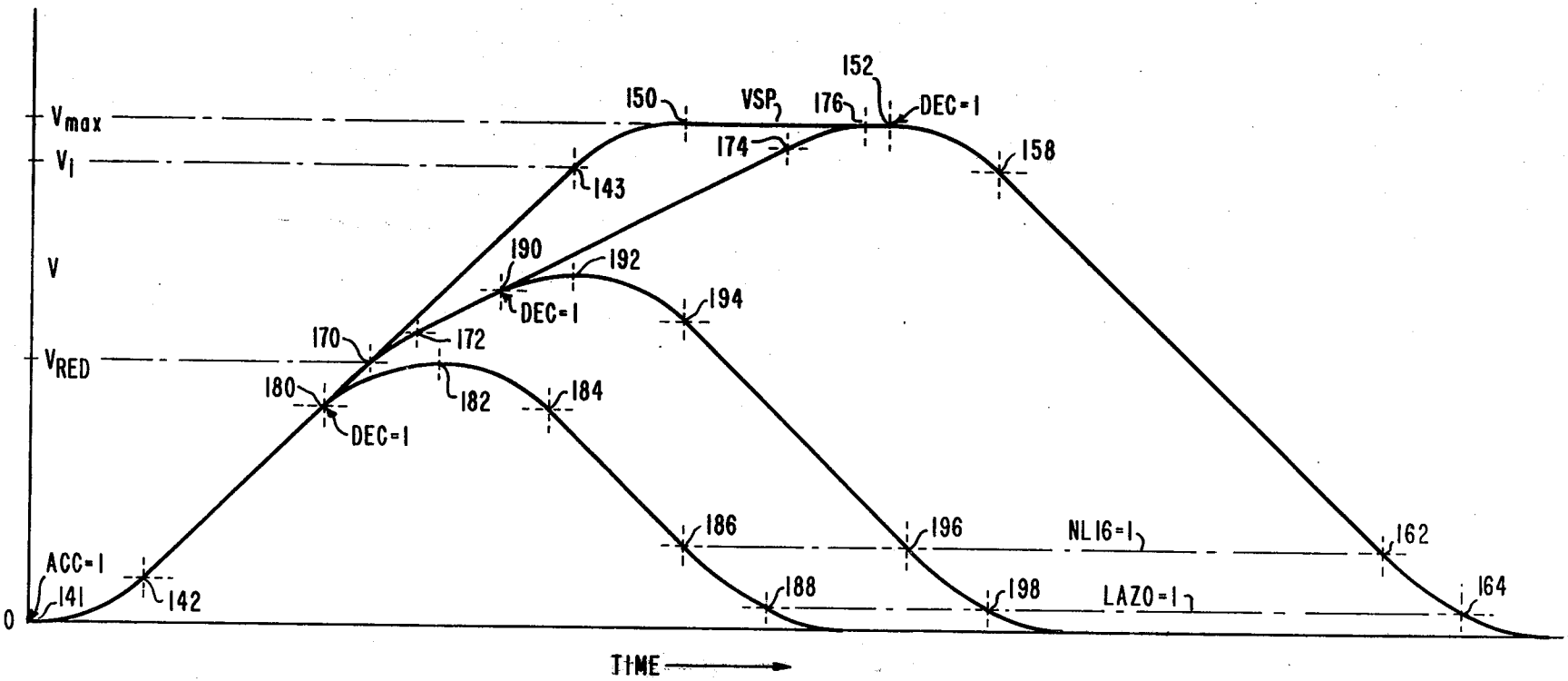
FIG. 5 is a graph which illustrates illustrative speed patterns developed according to the teachings of the invention, for short runs, as well as for runs in which the rated velocity is achieved.

The graph shown in FIG. 5 plots the voltage of the speed pattern signal VSP on the ordinate, versus time on the abscissa. The first phase of the speed pattern signal VSP, wherein the speed pattern starts at zero when ACC goes true, until constant acceleration is reached, occurs between point 141, i.e., zero velocity and point 142, on the curve VSP.

It will first be assumed that the elevator car 12 is making a run of sufficient distance that its rated or maximum velocity $V_{max}$ will be reached before the floor selector 34 determines that slow-down should be initiated. Thus, counter 114 will advance to a count equal to $a_{max}$ and will then hold this count as the elevator car linearly increases its speed according to the rated rate of acceleration. The second pulse train provides its pulses 124 at a constant rate when counter 114 is held at $a_{max}$, to add the velocity constant $V_k$ to register 126 at a constant rate. This second or constant acceleration phase of the speed pattern is illustrated in FIG. 5 as the curve portion which starts at point 142 and ends at point 143.

The output of the velocity register 126 is applied to a comparator function 144. A register 146 provides a 16-bit binary number equal to the rated or maximum velocity $V_{max}$, and a register 148 provides a 16-bit binary number equal to a velocity $V_1$. Velocity $V_1$ is the velocity at which the acceleration should start to be reduced to zero in a jerk limited manner, to cause the speed pattern VSP to smoothly approach and enter the maximum acceleration $V_{max}$ without overshoot.

When comparator function 144 detects that the output of the velocity register 126 has reached $V_1$, comparator 144 causes comparator 118 to enable the acceleration counter 114, and it also operates flip-flop 116 to cause the acceleration counter 114 to count down in response to the pulses of the first pulse train. As the count on the acceleration counter 114 is reduced, the rate of the second pulse train 124 is reduced, the velocity constant $V_k$ is added to the velocity register 126 at a slower and slower rate, until comparator 144 indicates $V_{max}$ has been reached. Comparator 144 then disables the velocity register 126 and holds the speed pattern at $V_{max}$. The change from maximum acceleration to maximum velocity in a jerk limited manner occurs between curve points 143 and 150 on the speed pattern curve VSP shown in FIG. 5.

The constant speed portion of the speed pattern occurs between points 150 and 152 of curve VSP . During this constant speed portion the counts on counter 114 and register 122 are each zero, and the count on register 126 represents the maximum velocity. Comparator function 118 detects when the acceleration drops to zero, via a register 151 which inputs zeros to a comparator located in the comparator function 118. A flip-flop 153 is set to note the fact that the acceleration is zero. It is essential that the acceleration be equal to zero before the velocity register 126 is decremented during the slow-down portion of the speed pattern, and flip-flop 153 must be set before the velocity register 126 is allowed to count down.

When the floor selector 34 determines that the elevator car is at that precise point at which slow-down should be initiated in order to stop the elevator car at a target floor according to a jerk and deceleration limited slow-down pattern, it provides a true signal DEC. At this point, two separate digital speed patterns are provided. The first digital speed pattern, which is a time dependent pattern, is the same as hereinbefore described, which appears as the count in the velocity register 126. The second digital speed pattern is a distance dependent speed pattern which is responsive to the distance from the elevator car to the target floor.

Instead of completely switching from a time dependent speed pattern to a distance dependent speed pattern when signal DEC goes true, such as disclosed in the hereinbefore mentioned U.S. Pat. No. 3,747,710, the present invention "slaves" the time dependent pattern to the distance dependent pattern. This arrangement has two major advantages. When control of an elevator drive motor is switched from one speed pattern signal to another speed pattern signal, it is important that the patterns match at the transfer point. A discontinuity in the patterns will be felt in the elevator car as a disagreeable bump. This transition may be smoothly made by single blending, such as disclosed in U.S. Pat. No. 3,651,892, which is assigned to the same assignee as the present application, using a comparator and analog switches. However, one of the objects of the present invention is to provide a speed pattern generator which is equally implementable by a microprocessor, as well as by hard-wired registers and logic. Signal blending is difficult to achieve in the microprocessor, and would probably require bringing the signals out of the microprocessor to signal blending hardware. The present invention assures a smooth transition from constant velocity to constant deceleration without the necessity of signal blending, and thus without requiring signal blending hardware. The second major advantage of the present invention is the fact that the time dependent signal is jerk controlled, and is also acceleration and velocity controlled. Thus, regardless of how rapidly the distance based speed pattern changes, the time based speed pattern will follow the change within the built-in jerk constraint of the time based signal. In addition to limiting jerk during the slow-down phase, upper and lower limits on the magnitude of the deceleration are imposed on the time based signal, until the point is reached where the deceleration is to be reduced to stop the elevator car at a floor. A lower limit may also be placed on the velocity magnitude of the time based signal, to insure that the elevator car is approaching the 16 inch point at a predetermined minimum speed. Thus, various failure modes of the distance based speed pattern, which modes may result in a relatively large deviation from the desired pattern, will not be followed by the time based speed pattern.

The distance based digital speed pattern starts with a distance-to-go counter 154. This counter always contains a count equal to the number of distance pulses DP which are necessary to decelerate the elevator car from its present velocity, and to stop the elevator car at a target floor according to a predetermined deceleration schedule. When signal DEC goes true, the distance-to-go counter 154 is decremented by the distance pulses DP, and the output of counter 154 is applied to a square root generator 156. The square root generator 156 provides a digital signal for the comparator function 144, which digital signal is responsive to the square root of the count in counter 154. The digital square root signal is stored in a $V_C$ register 160, the output of which is applied to comparator function 144.

When signal DEC goes true, comparator 118 enables the acceleration counter 114 to count the pulses of the first pulse train, and signal DEC sets flip-flop 116 to cause the acceleration counter 114 to count up. Since the acceleration is zero, signal DEC sets flip-flop 132 to cause the velocity register to be decremented by the velocity constant $V_k$ in response to the "carries" from the digital integrating means 122. Thus, the speed pattern VSP is reduced in a jerk limited manner, as hereinbefore described relative to the change in the speed pattern from zero acceleration to point 142 on the speed pattern curve VSP.

When maximum deceleration is reached at point 158 on the curve VSP of FIG. 5, the square root of the count value in the distance-to-go counter 154, which count is stored in the $V_C$ register 160, is compared with the count in the velocity register 126, by the comparator function 144. The square root generator 156 may perform the square root calculation via hardware dividers, or, if a microprocessor is used, the square root may be performed by a square root routine in the microprocessor.

At this point, the time dependent speed pattern signal is slaved to the distance dependent speed pattern signal. If the count of the velocity register 126 exceeds the calculated count in register 160, comparator 144 sets flip-flop 116 to cause the acceleration counter 114 to count up until the count of registor 160 exceeds the count on register 126, at which point comparator 144 sets flip-flop 116 to cause the acceleration counter 114 to count down. It is important to note that any difference between the two patterns at point 158 will merely result in the digital pattern appearing in the velocity register 126 to change in a jerk limited manner until the count of register 126 is the same as the count in register 160. Once the counts are equal, counter 114 will be decremented, or incremented as required, to cause the count of the velocity register 126 to closely follow the count in the register 160.

Upper and lower acceleration limit means 161 and 163 are rendered active during the constant deceleration portion of the speed pattern, to prevent the distance based pattern from driving the time based pattern beyond these predetermined upper and lower limits of deceleration.

The slaving of the time dependent speed pattern to the distance-to-go speed pattern is terminated when signal NL16 goes true at point 162 on the curve VSP shown in FIG. 5. This occurs when the elevator car reaches a point 16 inches from the target floor. A jerk limited flare-out in the speed pattern now begins, strictly under control of the time dependent speed pattern. This occurs, as illustrated graphically in FIG. 4, by setting flip-flop 116 by signal NL16 to cause the acceleration counter 114 to count the pulses of the first pulse train in the down direction. This portion of the speed pattern curve is thus developed in the same manner as described relative to the portion of the speed pattern curve VSP between points 143 and 150.

The jerk limited flare-out of signal VSP continues under the control of the time based speed pattern until the landing zone detector 51 detects the 10 inch point, indicated at 164 on curve VSP, and its signal LAZO goes true. Should the acceleration counter count to zero before the elevator car reaches the 10 inch point, a register 165 and comparator 144 will cooperate to prevent the speed pattern from falling below a predetermined minimum value. Register 165 contains a binary count equal to the minimum desired velocity of the elevator car as the elevator car approaches the 10 inch point, and if the comparator 144 detects this velocity it will prevent the velocity register 126 from being decremented below this value. This same $V_{min}$ comparator function would also prevent the car speed from falling below this minimum as the car approaches the 16 inch point.

As illustrated in FIG. 2, the hatch transducer 52 is responsive to the speed pattern signal MPSP. The hatch transducer 52 is provided with a variable gain via an automatic gain control, and it is connected such that it will attempt to follow the speed pattern signal MPSP. As the elevator car approaches the 10 inch landing zone, the output signal HTAN from the hatch transducer exactly follows the pattern MPSP. The hatch transducer speed pattern is applied to amplifier 49 via a gate 140 which is disabled until signal LAZO goes true at the 10 inch point. Thus, when signal LAZO goes true and blocks gate 138 while enabling gate 140, there is no step in the pattern applied to amplifier 49. Signal HT1 then reduces the speed pattern signal HTAN according to the configuration of the inductor plate located adjacent to the floor, to bring the elevator car precisely to floor level.

In some elevator systems, the acceleration rate is reduced at some predetermined velocity $V_{RED}$. Register means 166 is loaded with a 16-bit count responsive to this intermediate velocity and comparator 144, upon detecting this intermediate velocity, sets flip-flop 116 to cause the acceleration counter 114 to count down to a predetermined count which corresponds to the lower desired acceleration rate.

This predetermined count is set in an $a_{RED}$ register 168, and comparator 118 allows counter 114 to count down to this lower value, at which time this new lower count is held. This is illustrated on the curve VSP of FIG. 5. The velocity $V_{RED}$ is detected at point 170, and a jerk limited change in acceleration and velocity occurs until reaching the desired lower acceleration rate at point 172. If a target floor is not detected, the speed pattern will then increase linearly at the new acceleration rate until a velocity $V_{1R}$ is detected at point 174. $V_{1R}$ *is slightly higher than* $V_1$ since $V_{max}$ is being approached at a lower rate of acceleration. A jerk limited reduction in acceleration occurs from point 174 to point 176, at which point $V_{max}$ is reached without overshoot.

If a short run is made wherein signal DEC goes true before the elevator car reaches $V_{max}$, the speed pattern changes in a jerk limited manner to reduce acceleration to zero before the velocity register 126 is allowed to be decremented by the velocity constant $V_k$. If signal DEC is set at point 180 on curve VSP of FIG. 5, the velocity will be reduced in a jerk limited manner until the acceleration counter 114 is counted down to zero at point 182. The $a_O$ flip-flop 153 then sets the velocity register 126 to count down, and to allow the acceleration counter 114 to count up, to change the speed pattern VSP in a jerk limited manner until maximum deceleration is reached at point 184. The acceleration count is then slaved by the distance speed pattern until then 16 inch point is reached at 186. The slaving terminates at point 186, and the time based pattern begins the jerk limited flare-out by counting the acceleration counter 114 down, and at point 188 the pattern is switched to the hatch transducer 52.

In like manner, if signal DEC is set during the reduced acceleration mode between points 172 and 174, such as at point 190, the velocity register 126 will be maintained in its upward counting mode as the acceleration counter is counted down to zero at point 192. The acceleration counter 114 will then be set to count up as the velocity register 126 is set to count down, until maximum deceleration is reached at point 194. The time based speed pattern will then be slaved to the distance-to-go pattern until the elevator car reaches the 16 inch point at 196. The acceleration counter 114 will then be counted down to begin the jerk limited flare-out, and at the 10 inch point 198, the hatch transducer 52 will take over to bring the car precisely to floor level.

Figure 6:
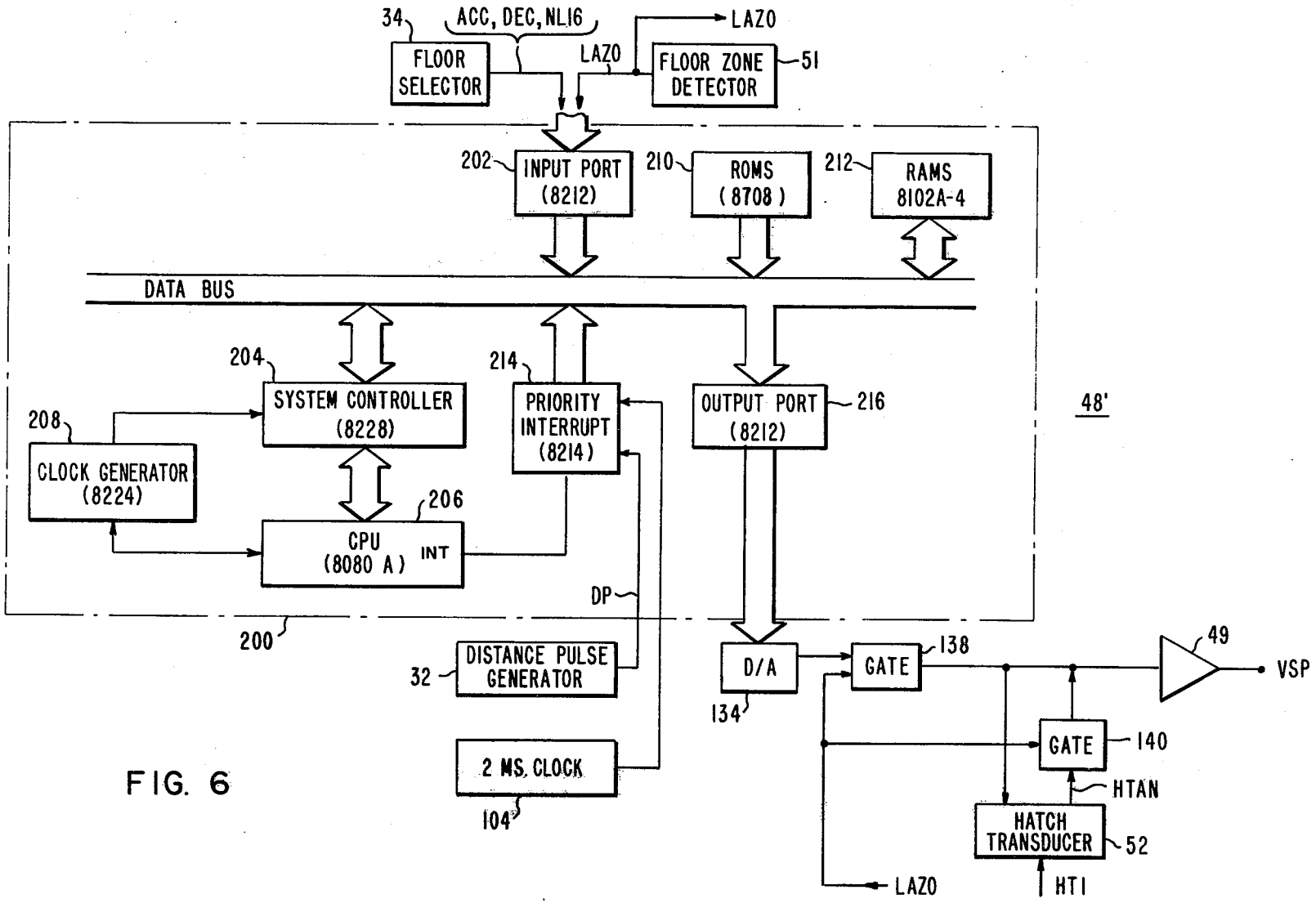
FIG. 6 is a block diagram of a preferred embodiment of the invention which utilizes a microprocessor to perform the functions set forth in FIG. 2.
Figure 7:
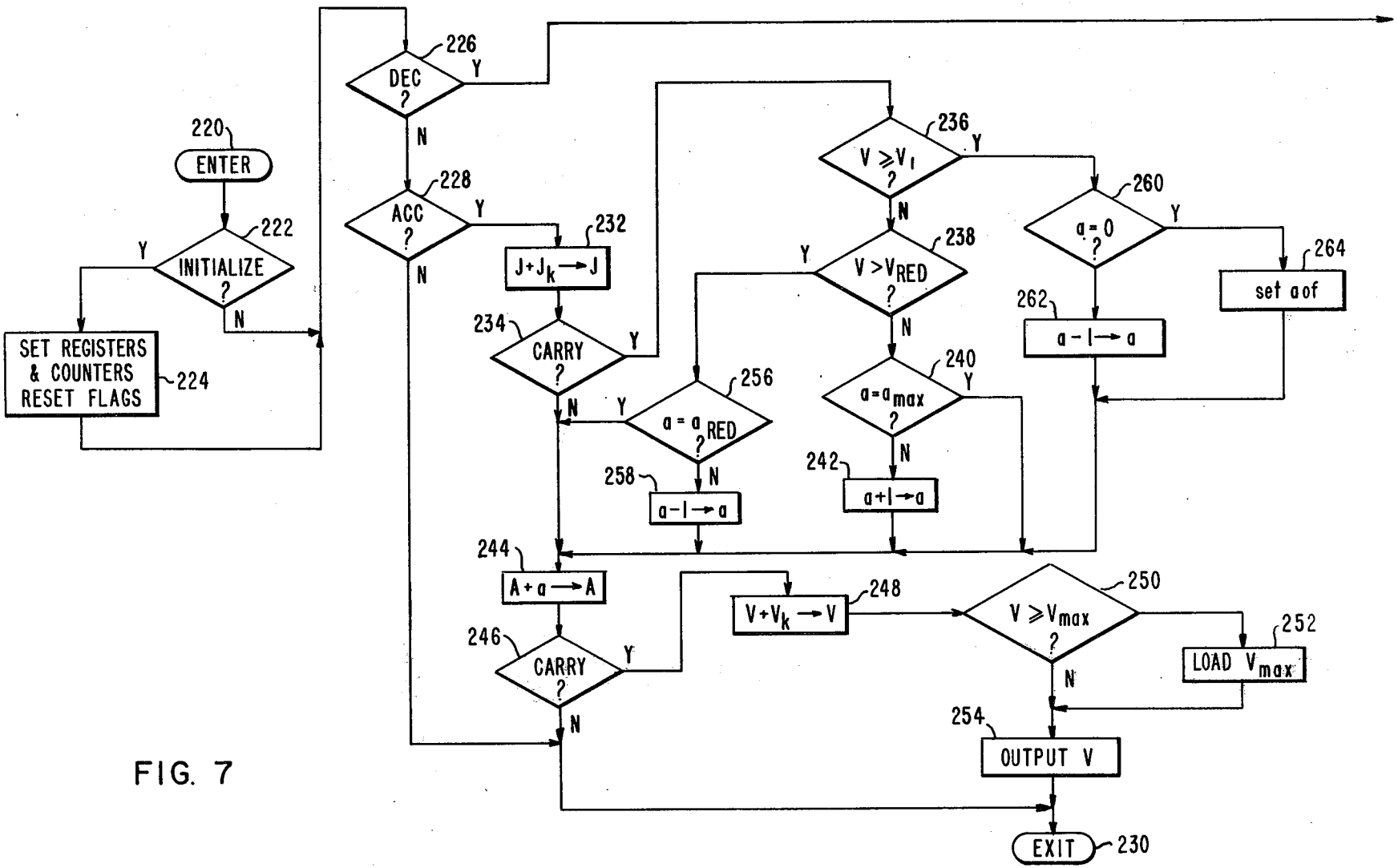
FIGS. 7 and 8 are flow charts which illustrate the programming of the microprocessor shown in FIG. 6 which is required to perform the functions set forth in FIG. 2.
Figure 8:
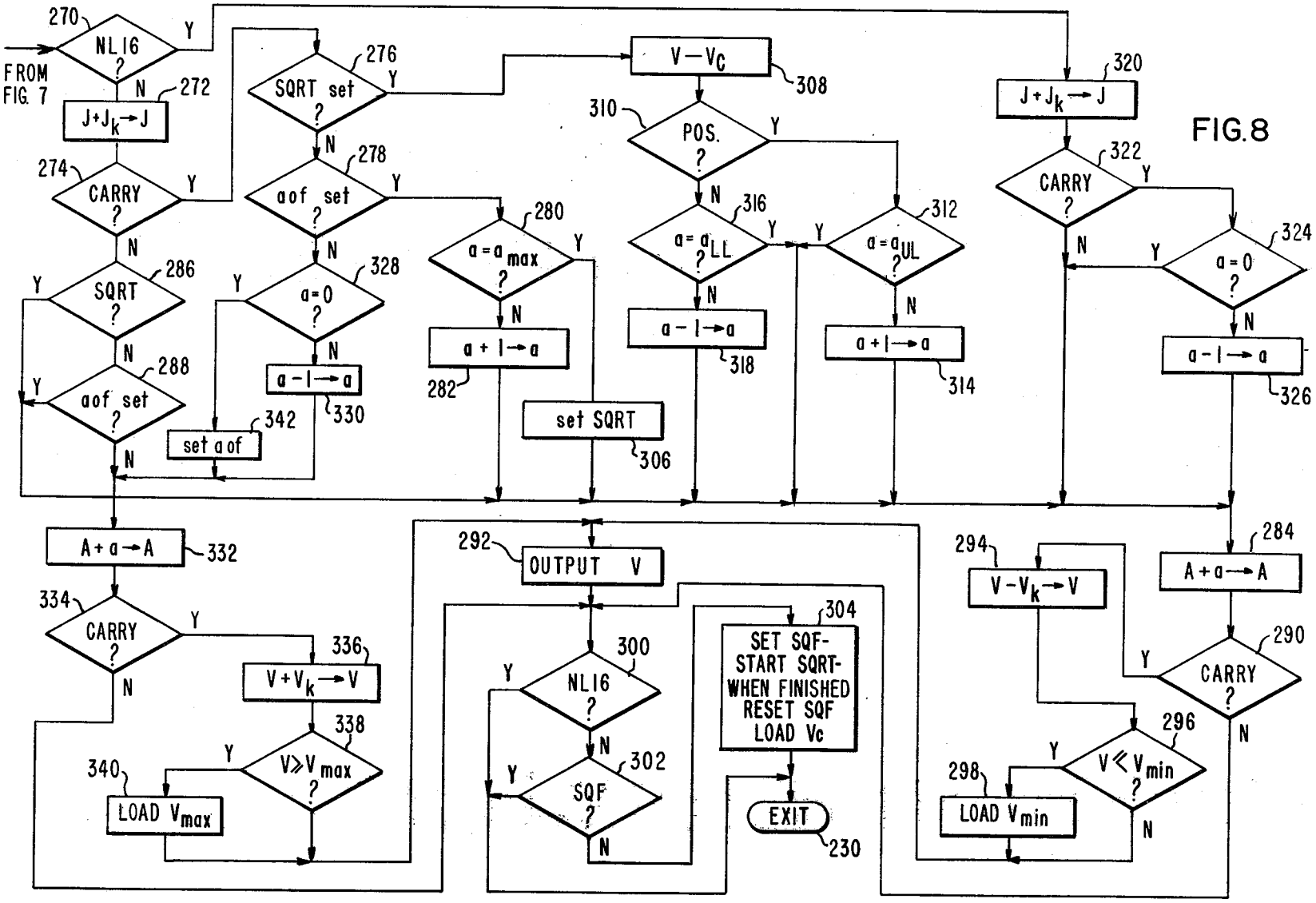

While the new digital speed pattern generator has many advantages, regardless of whether its implementation is accomplished with registers and hard-wired logic or by a microprocessor, it is especially suitable for implementation by a dedicated digital computer, such as a microprocessor. FIG. 6 is a block diagram of a speed pattern generator 48' which illustrates a microprocessor implementation of the invention. FIGS. 7 and 8 illustrate flow charts which may be used by a programmer of average skill to program the microprocessor to perform the functional aspects of the invention hereinbefore set forth. More specifically, speed pattern generator 48' includes a microprocessor 200, which will be assumed to be Intel's 8080, but any suitable microprocessor or digital computer may be used. Microprocessor 200 includes an input port 202 (Intel's 8212), a system controller 204 (Intel's 8228), a central processor or CPU 206 (Intel's 8080A), a clock generator 208 (Intel's 8224), a read-only-memory 210, also referred to as ROM 210 (Intel's 8708), a random access memory 212, also referred to as RAM 212 (Intel's 8102A-4), a priority interrupt 214 (Intel's 8214), and an output port 216 (Intel's 8212).

In this embodiment of the invention, an external floor selector 34 provides the signals ACC, DEC and NL16, but they could also be generated in a floor selector program stored in ROM 210. The external signals ACC, DEC, NL16 and LAZO are periodically read from the input port 8212 and stored in RAM 212. The two millisecond clock 104 and the distance pulse generator 32 are each connected to provide inputs for the priority interrupt 214. The two millisecond clock provides the timing for the iteration rate of the speed pattern generator. The distance pulses DP are counted until signal DEC is set, or $V_{max}$ is reached, whichever occurs first, and this count is counted down when signal DEC is set. This distance-to-go count is repetitively operated upon to provide a square root count, during the deceleration portion of the speed pattern. ROM 210 contains the program for performing the functions of the new and improved speed pattern generator 48'.

FIGS. 7 and 8 are flow charts which may be assembled to provide a detailed flow chart which sets forth a program for programming the microprocessor 200 to perform the functions of the invention. The program is entered at 220 every two milliseconds, and step 222 determines if the various counters and registers of the microprocessor should be initialized. When the elevator car completes a run, a flag will be set which indicates initialization is necessary. If initialization is necessary, step 224 sets the jerk register J to "ones", it sets the acceleration counter to zero, it sets the A register to "ones", the $V_C$ register to zero, and the V register to zero. It resets all program flags.

The program then advances to step 226, which is where the program would have proceeded had step 222 found that initialization was not necessary. Step 226 checks to see if signal DEC is true. Since the car is now stopped at a landing, signal DEC will not be true. Step 228 checks to see if signal ACC is true. If it is not, the program advances to the exit point 230. If a run has been requested by the floor selector, step 228 will find ACC set, and step 232 will add the selected jerk constant $J_k$ (190 in the example) to the count in the J register. Step 234 checks for a carry. Since step 224 set the J register to "ones", the first increment of the J register will provide a carry, and step 236 checks to see if the count in the V register has exceeded $V_1$. $V_1$, as hereinbefore described, is the velocity at which the acceleration should start to be reduced from its maximum value to zero in a jerk limited manner to enter the constant speed portion of the speed pattern signal. Since the velocity is zero at this time, step 238 checks to see if the velocity is greater than $V_{RED}$. If the acceleration is not to be reduced at a predetermined speed, this step would be eliminated. Since the velocity is zero at this time, the program advances to step 240 which checks the "a" counter to see if the maximum acceleration $a_{max}$ has been reached. Since the elevator car is still idle at this time, step 242 increments the a counter and advances to step 244 which adds the count of the a counter to the contents of the A register or digital integrator. Step 246 checks for a carry. Since step 224 set the A register to "ones", there will be a carry on the first increment of the A register and step 248 will increment the velocity register V by the velocity constant $V_k$ (87 in the example). Step 250 determines if the rated or maximum velocity $V_{max}$ has been reached. If it has, $V_{max}$ is loaded into the V register in step 252, and this value is output to the D/A converter 134 in step 254. If $V_{max}$ has not been reached, the count in the V register is output to the D/A converter in step 254.

The program is entered again on the next interrupt by the 2 millisecond timer, and the acceleration counter "a" will continue to be incremented until step 240 finds that the maximum acceleration $a_{max}$ has been reached. When this occurs, step 242 will be bypassed, and the velocity will continue to build in the V register via step 248.

If the acceleration is to reduced at a predetermined velocity $V_{RED}$, step 238 will detect when velocity $V_{RED}$ has been reached, and steps 256 and 258 will decrement the a counter until the desired lower acceleration $a_{RED}$ is reached.

The velocity will continue to build in the V register until step 236 detects that the velocity $V_1$ has been reached, at which point steps 260 and 262 will decrement the acceleration counter a on each running of the program until step 260 detects that it has been reduced to zero. When the acceleration counter reaches zero, step 264 sets the flag aof to indicate this fact. This flag is checked when signal DEC is set to insure that the acceleration has been reduced to zero before the velocity register V is decremented.

The constant velocity portion of the run has now been entered, and steps 252 and 254 will continue to load $V_{max}$ into the velocity register V, and $V_{max}$ will be output to the D/A converter, respectively. When the floor selector detects that the elevator car has reached the precise point at which slow-down should start to stop the elevator car at the target floor within the predetermined jerk and deceleration constraints, it will provide a true signal DEC and step 226 will advance the program to step 270 in FIG. 8.

Step 270 checks to see if signal NL16 is true. Since the elevator car is not 16 inches from the target floor at this time, step 272 adds the jerk constant $J_k$ to the contents of the J register, and step 274 checks for a carry. If there is a carry, step 276 checks to see if a flag SQRT has been set. Flag SQRT, when set, indicates the slaving of the time dependent pattern to the distance dependent pattern should start. Step 276 will find the flag SQRT is not set, and step 278 determines if the acceleration is zero by checking flag aof. It will be assumed that signal DEC was set after the maximum velocity portion of the pattern was reached, and therefore flag aof will be set (see steps 260 and 264 of FIG. 7).

Step 280 determines if the deceleration has increased to its maximum value. At this point, it has not. Step 282 increments the a counter, and the program advances to step 284.

If the carry test of step 274 found no carry, step 286 checks to see if the square root flag SQRT has been set. Since it has not been set at this point, step 288 checks to see if the zero acceleration flag aof has been set. Since it has been set, by step 264 of FIG. 7, the program advances to step 284.

Step 284 adds the contents of the a counter to the A register and stores the sum in the A register. Step 290 checks for a carry. If there is no carry, the program advances to step 292. If there is a carry, step 294 decrements the V register by the velocity constant $V_k$. Step 296 determines if the velocity has been reduced to a predetermined minimum value $V_{min}$, below which the speed pattern should not drop as the 16 inch point is approached. If the velocity count is less than $V_{min}$, step 298 loads $V_{min}$ into the velocity register V and advances to step 292. If the velocity count is above $V_{min}$, step 296 proceeds directly to step 292.

Step 292 outputs the velocity count to the D/A converter 134 and step 300 checks to see if the car has arrived at the 16 inch point. Since it has not, at this time, step 302 checks to see if a flag SQF has been set. Since it has not been set, step 304 sets the flag SQF, and it performs the square root routine on the contents of a distance-to-go counter 154. The program then exits at 230. Flag SQF is required because the square root routine takes a relatively long time to perform. If the program is interrupted while in the square root routine, the flag SQF prevents you from starting another calculation before the prior calculation has been completed. When the square root routine has been completed, it resets flag SQF and loads the calculation into the $V_C$ register. Thus, when step 302 finds flag SQF set, it indicates the previous square root routine has not been completed and no new data is ready for the $V_C$ register. Thus, step 304 is skipped and the program exits at 230.

The program continues to loop through these hereinbefore mentioned steps until step 282 has advanced the acceleration counter a to $a_{max}$, at which time step 280 will branch to step 306 which sets the flag SQRT.

The next time through the program, step 276 will find flag SQRT set and advance to step 308. This starts the "slaving" portion of the speed pattern, with the contents of the V register being made to follow the contents of the $V_C$ register in a jerk limited manner.

Step 308 compares the counts of the V and $V_C$ registers and step 310 determines which is larger. If the count of the V register is less than the count of the $V_C$ register, the V count should be increased. This is accomplished by reducing the rate of deceleration, and then the acceleration count on the "a" counter should be reduced, but step 316 checks to make sure that the acceleration hasn't already been reduced to a predetermined lower limit (function 163 of FIG. 2). If the acceleration hasn't already been reduced to this lower limit, step 318 decrements the a counter, and the program advances to step 284. If the acceleration count is at the lower limit, the program bypasses step 318 and advances directly to step 284.

If step 310 finds that the count in the V register is more than the count in the $V_C$ register, the count in the V register should be reduced. This is accomplished by increasing the rate of deceleration, and then the count in the acceleration counter a should be increased. Step 312, however, checks to see if the acceleration is already at a predetermined upper limit (function 161 of FIG. 2). If it is not at the upper limit, step 314 increments the a counter and the program advances to step 284. If it is already at the upper limit, step 314 is bypassed, and the program advances directly to step 284.

The program repetitively loops through the slaving steps until the car position counter indicates the car is 16 inches from the target floor, and step 270 finds that signal NL16 is true. The program then branches to step 320 which adds the jerk constant $J_k$ to the contents of the J register, and step 322 checks for a carry. If there is a carry, step 324 checks to see if the count of the a counter has been reduced to zero. If not, step 326 decrements the a counter and the program advances to step 284. If the acceleration count is zero, step 324 bypasses step 326 and advances directly to step 284. The acceleration counter should not reach zero before the 10 inch point under ordinary circumstances. However, even if the acceleration count is reduced to zero before the 10 inch point, step 296 insures that the velocity will not be reduced below a predetermined minimum value, insuring that the elevator car will not be stalled for some reason before reaching the hatch transducer.

If signal DEC is set on a short run before the acceleration has been reduced to zero and flag aof set in step 264 of FIG. 7, a carry from the J register, checked in step 274, will bring the program to step 278. Step 278 will find that flag aof is not set and step 328 checks to see if the count in the a counter is zero. If it is not, step 330 decrements the count of the a counter and the program advances to step 332.

Step 332 adds the count of the a counter to the count of the A register, and step 334 checks for carry. If none, the program advances to step 292. If there is a carry, step 336 adds the velocity constant $V_k$ to the contents of the V register, and step 338 checks to make sure the maximum velocity $V_{max}$ has not been exceeded. If it has, step 340 loads $V_{max}$ into the V register. If not, step 338 advances directly to step 292.

If step 274 finds no carry, the program advances to step 288 and flag aof is checked. Since the acceleration is not zero at this time, the program advances to step 332.

This portion of the program will then be continuously repeated upon each running of the program until step 328 finds the count of the a counter has been reduced to zero, which results in the setting of flag aof in step 342. Once flag aof is set, the program will run the same as hereinbefore described wherein signal DEC was set after the speed pattern had reached the constant velocity ($V_{max}$) phase.

I claim as my invention:

1. A speed pattern generator for providing a speed pattern signal which is changeable between zero and a predetermined maximum value within predetermined jerk and acceleration constraints, comprising:

acceleration means and velocity means each selectively incrementable and decrementable by first and second predetermined binary increments, respectively, jerk means providing a first pulse train at a predetermined constant average rate for said acceleration means, with said rate being indicative of the maximum rate at which said acceleration means should be changed by the selected first binary increment, first control means enabling said acceleration means to be incremented, and subsequently decremented, in response to said first pulse train, when it is desired to increase the speed pattern signal from zero to a predetermined magnitude, digital integrating means providing a second pulse train, said second pulse train having a controllable rate, with said rate being responsive to the binary count on said acceleration means, said rate being indicative of the rate at which said velocity means should be changed by the selected second binary increment, and second control means enabling said velocity means to be incremented in response to said second pulse train, to increase the binary count on said velocity means from zero to a predetermined value.

2. The speed pattern generator of claim 1 wherein the first control means enables the acceleration means to be incremented, and subsequently decremented, in response to the first pulse train, when it is desired to reduce the speed pattern signal towards zero, and the second control means enables the velocity means to be decremented in response to the second pulse train to reduce the binary count on the velocity means towards zero.

3. The speed pattern generator of claim 1 wherein the binary count on the velocity means provides a first digital speed pattern signal, and including means providing a second digital speed pattern signal in response to a predetermined parameter, and wherein the first control means slaves the first digital speed pattern signal to the second digital speed pattern signal by enabling the first pulse train to increment and decrement the acceleration means in response to the first digital speed pattern signal being less than, and greater than, the second digital speed pattern signal, respectively.

4. The speed pattern generator of claim 1 wherein the jerk means includes counting means which resets and provides a carry signal each time its capacity is exceeded, and clock means, said counting means being incremented by a third predetermined binary increment in response to said clock means, with the carry signals providing the first pulse train.

5. The speed pattern generator of claims 1 or 4 wherein the digital integrating means includes counting means which provides a carry each time its capacity is exceeded, said counting means repetitively adding the binary count of the acceleration means to its count at a predetermined rate, with the carry signals providing the second pulse train.

6. The speed pattern generator of claim 1 wherein the first binary increment is equivalent to 1, and the second binary increment is equivalent to a number which exceeds 1.

7. The speed pattern generator of claim 4 wherein the first binary increment is equivalent to 1, and the second and third binary increments are each equivalent to numbers which exceed 1.

8. The speed pattern generator of claim 4 wherein the digital integrating means includes counting means which adds the binary count of the acceleration means to its count in response to the clock means.

9. A speed pattern generator for providing a speed pattern signal which is changeable between zero and a predetermined maximum value within predetermined jerk and acceleration constraints comprising:

acceleration means selectively incrementable and decrementable by a first predetermined binary increment, jerk means providing a first pulse train at a predetermined constant average rate, with said rate being indicative of the maximum rate at which said acceleration means should be changed when using said first binary increment, first control means enabling said acceleration means to be incremented by said first binary increment in response to the pulses of said first pulse train, when the speed pattern signal is to be provided, until the acceleration means reaches a predetermined binary count indicative of a predetermined acceleration, velocity means selectively incrementable and decrementable by a second predetermined binary increment, digital integrating means providing a second pulse train, said second pulse train having a controllable rate responsive to the count on said acceleration means, with the rate of said second pulse train being indicative of the rate at which said velocity means should be changed when using said second binary increment, and second control means enabling said velocity means to be incremented by said second binary increment in response to said second digital pulse train, until the velocity means reaches a predetermined value, said first control means being responsive to said velocity means, enabling said acceleration means to be decremented towards zero by the first binary increment in response to said first digital pulse train, when the velocity means reaches a predetermined binary count, to reduce the rate of change of the count on said velocity means as the predetermined value is approached.

10. The speed pattern generator of claim 9 wherein the jerk means includes counting means which provides a carry signal each time its capacity is exceeded, and clock means, said counting means being incremented by a third predetermined binary increment in response to said clock means, with the carry signals providing the first pulse train.

11. The speed pattern generator of claims 9 or 10 wherein the digital integrating means includes counting means which resets and provides a carry each time its capacity is exceeded, said counting means repetitively adding the binary count on the acceleration means to its count at a predetermined rate, with the carry signals providing the second pulse train.

12. The speed pattern generator of claim 9 wherein the first binary increment is equivalent to 1, and the second binary increment is equivalent to a number which exceeds 1.

13. The speed pattern generator of claim 10 wherein the first binary increment is equivalent to 1, and the second and third binary increments are each equivalent to numbers which exceed 1.

14. The speed pattern generator of claim 10 wherein the digital integrating means includes counting means which adds the binary count of the acceleration means to its count in response to the clock means.

15. The speed pattern generator of claim 9 wherein the first control means, in response to a predetermined parameter when the velocity means has a count greater than zero, and the acceleration means has a count equal to zero, enables the acceleration means to be incremented to a predetermined binary count, and subsequently decremented, in response to the first pulse train, the digital integrating means provides the second pulse train in response to the binary count on the acceleration means, and wherein the second control means, in response to the predetermined parameter, enables the velocity means to be decremented towards zero by the second binary increment in response to the second pulse train.

16. The speed pattern generator of claim 15 wherein the binary count of the velocity means provides a first digital speed pattern signal, and including means providing a second digital speed pattern signal in response to a predetermined parameter, and wherein the first control means slaves the first digital speed pattern signal to the second digital speed pattern signal when the velocity means is being decremented, by enabling the first pulse train to increment and decrement the acceleration means, in response to the first digital speed pattern signal being less than, and greater than, the second digital speed pattern signal, respectively.

17. A speed pattern generator for directing the movement of an elevator car from one floor of a building to another floor, comprising:

means providing a first digital speed pattern signal which changes within predetermined maximum jerk and acceleration constraints, means providing a second digital speed pattern signal responsive to the slow-down distance from the elevator car to a floor at which it is to stop, and means slaving the first digital speed pattern signal to the second digital speed pattern signal, with said first digital speed pattern signal being used to direct the movement of said elevator car.

18. The speed pattern generator of claim 17 wherein the slaving means only slaves the first digital speed pattern signal to the second digital speed pattern signal during a deceleration phase of the run, while the first digital speed pattern signal controls the movement of the elevator car without slaving during other portions of the run.

19. A speed pattern generator for directing the movement of an elevator car from one floor of a building to another floor, within predetermined maximum jerk and acceleration constraints, comprising:

first means providing a first digital speed pattern signal for decelerating the elevator car, said first means including jerk means which provides a first pulse train at a predetermined constant average rate, acceleration means which has a binary count which is selectively incrementable and decrementable by said first pulse train, digital integrating means which provides a second pulse train at a rate proportional to the binary count on said acceleration means, and velocity means which has a binary count which is decrementable by said second pulse train, second means providing a second digital speed pattern signal responsive to the distance to go from the elevator car to the floor at which it is to stop, and control means responsive to the difference between said first and second digital speed pattern signals for incrementing said acceleration means responsive to said first pulse train when the count of said first digital speed pattern signal is less than the count of said second digital speed pattern signal, and for decrementing said acceleration means responsive to said first pulse train when the count of said first digital speed pattern signal is greater than the count of said second digital speed pattern signal.

20. The speed pattern generator of claim 19 wherein the first means provides the first digital speed pattern signal for the acceleration and constant velocity portions of the run of the elevator car, with the second means slaving the first digital speed pattern signal to the second digital speed pattern signal only during a deceleration portion of the run.

21. The speed pattern generator of claim 19 including means responsive to the first digital speed pattern signal for providing a first analog speed pattern signal, hatch transducer means providing a second analog speed pattern signal, the second analog speed pattern signal of said hatch transducer means being slaved to follow the first analog speed pattern signal as the elevator car approaches the floor at which it is to stop, and means switching from the first analog speed pattern signal to the second analog speed pattern signal at a predetermined location of the elevator car relative to the floor at which it is to stop.

22. The speed pattern generator of claim 19 wherein the second means slaves the first digital speed pattern signal to the second digital speed pattern signal, only after the first speed pattern signal is changed to a constant deceleration portion of the speed pattern.

23. The speed pattern generator of claim 19 including means providing upper and lower acceleration limits for the first speed pattern signal while being slaved to the second speed pattern signal, which limit the count range of the first digital speed pattern signal, regardless of the count on the second digital speed pattern signal.

* * * * *